US006519207B1

(12) United States Patent
Lukacsko

(10) Patent No.: US 6,519,207 B1
(45) Date of Patent: Feb. 11, 2003

(54) OUTDOOR GLOVE WATCH

(76) Inventor: Jason B. Lukacsko, 2800 Albemarle Dr., Reynoldsburg, OH (US) 43068

( * ) Notice: Subject to any disclaimer, the term of this patent is extended or adjusted under 35 U.S.C. 154(b) by 0 days.

(21) Appl. No.: 09/166,757

(22) Filed: Oct. 5, 1998

(51) Int. Cl.[7] ..... G04B 37/00; A44C 1/00

(52) U.S. Cl. ..... 368/10; 368/281; 368/282; 368/316; 368/276; 224/172; 224/175; 224/217; 224/903; 2/160; 2/249

(58) Field of Search ..... 368/10, 280–290; 224/172, 175, 217, 903; 2/160, 249

(56) References Cited

U.S. PATENT DOCUMENTS 1,628,278 A 5/1927 Scheuer
4,387,838 A 6/1983 Jackson ..... 224/170
5,623,731 A 4/1997 Ehrgott et al. ..... 2/160
5,779,113 A 7/1998 Huang ..... 224/172

*Primary Examiner*—David Martin
*Assistant Examiner*—Jeanne-Marguerite Goodwin
(74) *Attorney, Agent, or Firm*—David A. Greenlee

(57) ABSTRACT

An all-weather watch to be worn on the outside of one of the heavy-duty gloves of a glove wearer, such as a skier, snow boarder, hunter or motorcyclist, in cold and/or inclement weather. A length-adjustable elastic strap comprises a front strap portion which extends from the watch case and stretches to loop about at least one glove finger. A rear strap portion extends from the case and stretches outwardly to loop about the glove wrist to position the watch on the back of the glove. The rear strap portion is maintained in position by the stretching of the elastic strap, the friction between the strap and the glove and by the cinching action of the loop around the glove wrist, thus not requiring the use of a clasp or other fastener. This enables the watch to be readily removable from the glove by grasping the rear loop and stretching it to move over the glove body and thumb. Putting on and removing the watch can easily be performed by the wearer's other gloved hand.

9 Claims, 2 Drawing Sheets

OUTDOOR GLOVE WATCH

TECHNICAL FIELD

This invention relates to a watch or other device to be worn by an outdoorsman such as a skier, snowboarder, hunter or motorcyclist and, more particularly, to such devices to be worn in cold and inclement weather for ready observation of the device face.

BACKGROUND OF THE INVENTION

Outdoorsmen such as skiers, snowboarders, hunters, or motorcyclists wear bulky gloves, and often need to wear watches and other devices such as altimeters and chronographs which provide information to the wearer. Conventional devices are worn on the wearer's wrist beneath the wearer's bulky glove. In this position, the device face is hidden from view and is not readily observable unless both hands are used to expose the face, requiring conscious attention by the wearer.

Several attempts have been developed to provide a watch for outdoorsmen with a watch having a face which is continuously observable. Examples of this are disclosed in U.S. Pat. Nos. 4,387,838 and 5,623,731, both of which require mounting as part of the glove and, thus, are not transferable to other gloves.

It would be desirable to provide a device which provides continuously viewable face that is mountable on a glove, but is transferable to other gloves.

Watches have been developed which, for the sake of styling, are worn on the back of the hand. Examples of these are shown in U.S. Pat. Nos. 1,628,278 and 5,779,113. In both patents, the watch is mounted on a cord and includes a clasp which must be manipulated to remove and mount the watch. Neither arrangement is suitable for glove mounting, since neither is sufficiently durable for all-weather use, nor is easily removable with a gloved hand.

It would be desirable to provide an all-weather device such as a watch which is readily mountable on and removable from an outdoorsman's glove for continuous observance of its face.

SUMMARY OF THE INVENTION

It is therefore an object of this invention to provide an all-weather watch which is readily mountable on and removable from a skier's glove for continuous observance of its face.

In one aspect, this invention features an all-weather device to be worn on the outside of one of the heavy-duty gloves of a glove wearer, such as a skier or snow boarder, in cold or inclement weather, said glove having fingers, thumb, body and wrist portions. The device preferably comprises a weatherproof device case having a face to display information, a front elastic strap extending from the case and stretching to loop about at least one glove finger, and a rear elastic strap extending from the case and stretching outwardly to loop about the glove wrist to position the device on the back of the glove. The rear strap is maintained in position by the stretching of the elastic strap, the friction between the strap and the glove and by the cinching action of the loop around the glove wrist. The device is readily removable from the glove by grasping the rear loop and stretching it to move over the glove body and thumb.

In another aspect, this invention features an all-weather watch to be worn on the outside of one of the heavy-duty gloves of a glove wearer, in cold or inclement weather, said glove having fingers, thumb, body and wrist portions. The watch comprises a weatherproof watch case having a face to display information, a length-adjustable elastic strap comprising a front strap portion extending from the case and stretching to loop about at least one glove finger, and a rear strap portion extending from the case and stretching outwardly to loop about the glove wrist to position the watch on the back of the glove. The rear strap portion is maintained in position by the stretching of the elastic strap, the friction between the strap and the glove and by the cinching action of the loop around the glove wrist, such that the watch is readily removable from the glove by grasping the rear loop and stretching it to move over the glove body and thumb.

These and other objects and features of this invention will become more readily understood by reference to the following detailed description of a preferred embodiment, taken in conjunction with the appended drawings, in which:

DESCRIPTION OF THE PREFERRED EMBODIMENT

Figure 1:
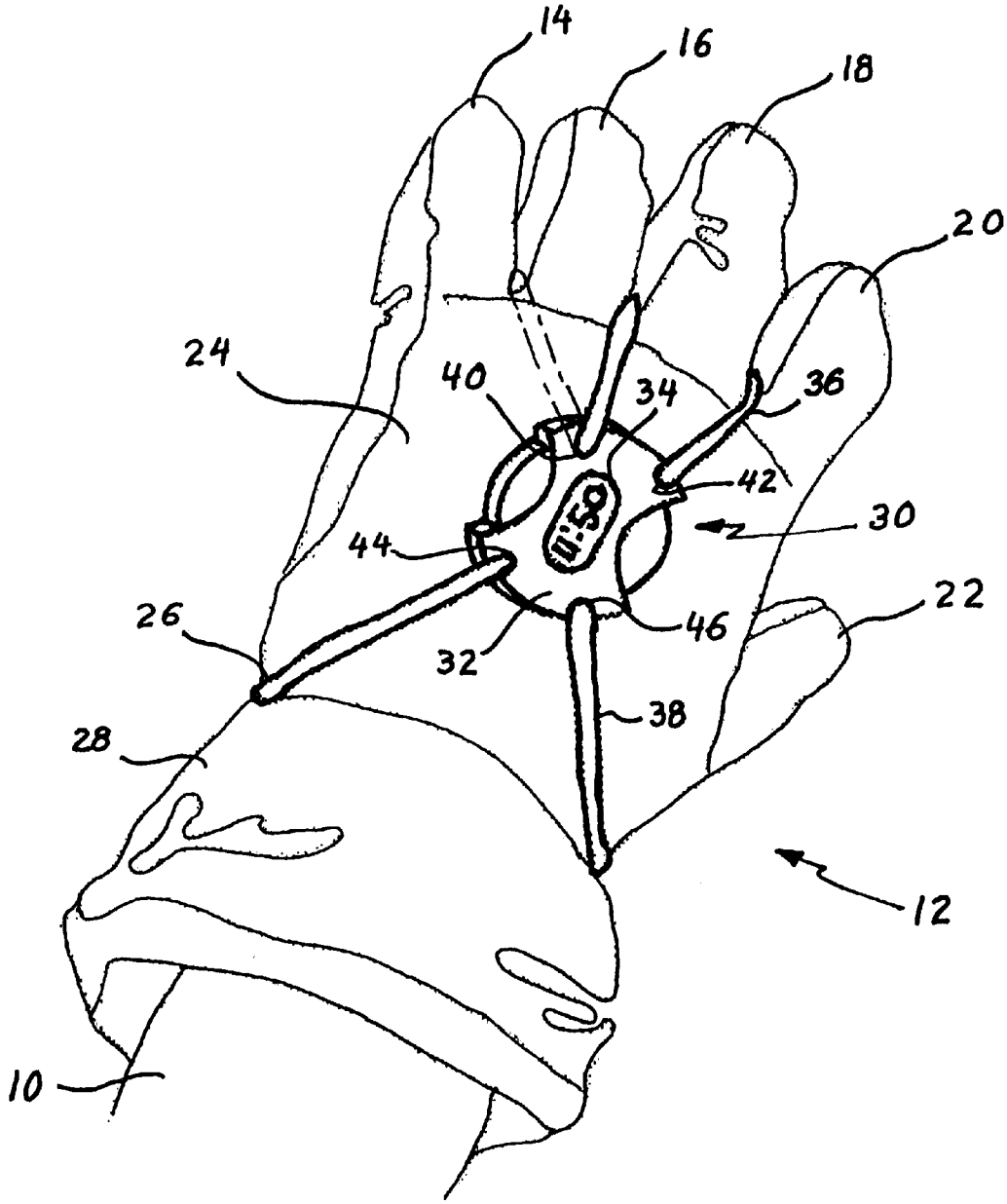
FIG. 1 is a perspective view of a skier's gloved hand wearing an all-weather watch according to this invention.

FIG. 1 illustrates an outdoorsman's arm 10 which terminates in a hand (not shown) that wears an all-weather insulated skier's glove 12. Glove 12 could be any heavy-duty insulated glove worn by snowboarders, and others for outdoor activities in cold and/or inclement weather. Glove 12 has fingers 14, 16, 18 and 20 and a thumb 22 extending from the glove body 24 that terminates in a wrist portion 26 from which extends a cuff 28.

A glove watch or other device 32 includes a preferably plastic weatherproof case 32 having a face 34. Watch 32 is positioned centrally on the back of glove body 24 so as to be readily observable by the glove wearer. A front elastic strap portion 36 extends forwardly from watch case 32 and loops around glove finger 18, as shown in solid lines in FIG. 1. Alternatively, front strap portion 36 can loop around both glove fingers 16 and 18, as shown in phantom lines. A rear elastic strap portion 38 extends rearwardly from watch case 32 and loops around the wrist portion 26 of glove 12.

Figure 2:
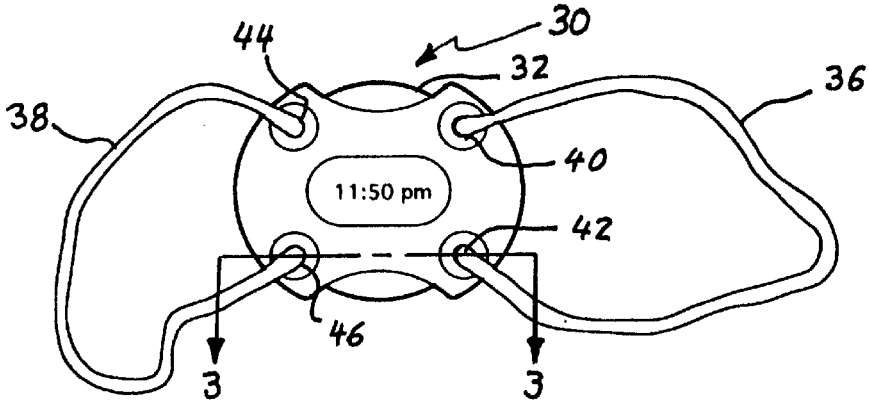
FIG. 2 is a plan view of the all-weather glove watch of FIG. 1.

Referring additionally to FIG. 2, front strap portion extends from closely-spaced apertures 40 and 42 in watch case 32, while rear strap portion 38 extends from closely-spaced apertures 44 and 46 in watch case 32. Elastic strap portions 36 and 38 are preferably commercially-available elastic cord material formed of fabric-covered rubber. Watch 30 requires no clasp or other fastener to remain in the illustrated position regardless of movement of glove 12 as the wearer's hand moves through a full range of motion during skiing or other outdoor activity. The reason for this is the cinching action of rear strap portion 38 as it stretches and loops outwardly from apertures 44 and 46 around wrist portion 26, and the frictional contact between the strap material and glove material. This is very important, because, if a clasp or other fastener were required to maintain the watch in position, it would be difficult to put on and remove.

It is frequently desirable to put on or remove the watch when the user is fully gloved, which would be impossible if this required operation of a clasp or other fastener. Thus, it is imperative that the watch be able to removed or put on by use of only a gloved hand. The watch according to this invention is easily put on by use of only the wearer's other gloved hand by merely looping front strap portion 36 about finger 18 (or fingers 16 and 18), and stretching rear strap portion 38 and slipping it over glove body 24 and thumb 22 to a position around wrist portion 26. There the watch will remain until purposefully removed by merely stretching rear strap portion 38, pulling it forwardly over glove body 24 and thumb 22, and pulling front strap portion off finger 18 (or fingers 16 and 18), again easily accomplished by the wearer's other gloved hand.

Figure 3:
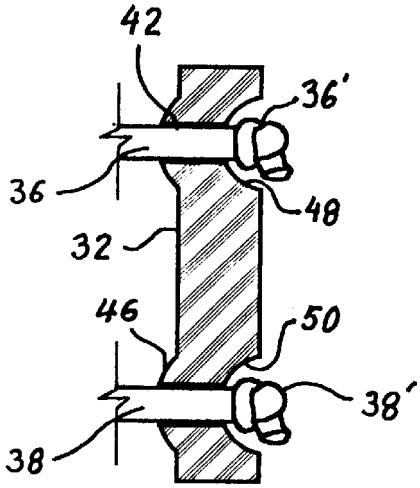
FIG. 3 is an enlarged sectional view taken along line 3—3 of FIG. 2.

The front and rear strap loops 36 and 38 can be separate or formed of a single length of elastic strap material. FIGS. 2 and 3 illustrate a single length of material having free ends which extend through watch case apertures 42 and 46 and terminate in respective knots 36' and 38' which fit in depressions 48 and 50 in watch case 32. With this arrangement, the length of strap 36, 38 can be varied to adapt to different sizes of gloves by re-tying one of knots 36, 38'. Also, the strap can be slid through apertures 40 and 44 to change the relative sizes of strap portions 36 and 38 to variably position watch 32 on the back of glove body 24. Of course, each strap portion 36, 38 could be separate lengths, each end of which would terminate in a knot fitting in apertures in the back of the watch case.

Figure 4:
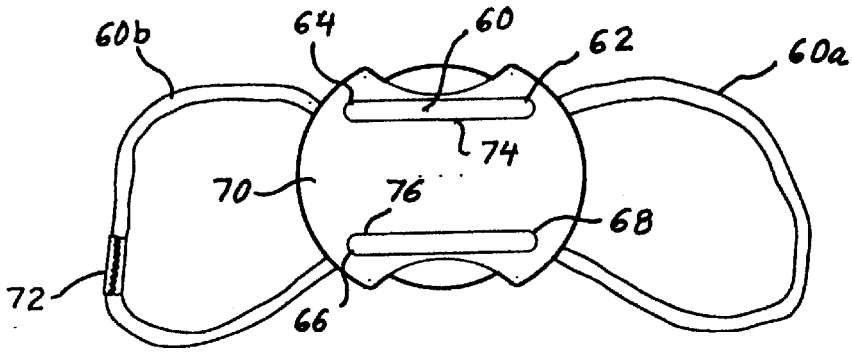
FIG. 4 is a rear view of another embodiment of this invention featuring a single elastic band.

An alternative embodiment is illustrated in FIG. 4. Here a single length of elastic cord 60 extends through apertures 62, 64, 66 and 68 through watch case 70, forming front and rear loops 60*a* and 60*b*. The free ends of cord 60 are secured together by a clamp 72. The portion of cord 60 which extends between apertures 62 and 64 lies in a groove 74 in the back of watch case 70, while the portion extending between apertures 66 and 68 lies in a groove 76 formed in the back of watch case 70. By sliding cord 60 through any pair of apertures, the relative sizes of strap portions 60*a* and 60*b* can be changed.

Thus this invention provides an all-weather watch which is readily mountable on and removable from an outdoorsman's glove by the use of the other gloved hand for continuous observance of its face by the wearer. Many obvious modifications could be made without departing from the scope of this invention as defined by the appended claims.

I claim:

1. An all-weather device to be worn on the outside of one of the heavy-duty gloves of a glove wearer, in cold or inclement weather, said glove having fingers, a thumb, a body and a wrist, comprising a case having a face to display information, a front elastic strap extending from the case and stretching to loop about at least one glove finger, and a rear elastic strap extending from the case and stretching outwardly to loop about the glove wrist to position the device on the back of the glove, whereby the rear strap is maintained in position solely by the stretching of the elastic strap, the friction between the strap and the glove and by the cinching action of the loop around the glove wrist, such that the device is readily removable from the glove by grasping the rear loop and stretching it to move over the glove body and thumb.

2. The all-weather device of claim 1, wherein the device is a watch.

3. The all-weather device of claim 1, wherein at least one of the elastic straps is length adjustable to accommodate various glove sizes.

4. The all-weather device of claim 2, wherein both elastic straps are length adjustable.

5. The all-weather device of claim 4, wherein the device has four apertures, and both straps are formed from a single length of strap material which is threaded through these apertures to form the loops.

6. The all-weather device of claim 5, wherein the single length of strap material has two ends, each being enlarged to prevent passage through the apertures.

7. The all-weather device of claim 4, wherein the device has four apertures, and each strap has enlarged ends to prevent passage of the ends through the apertures, one enlarged strap end being a knot which is adjustable to adjust the strap length.

8. An all-weather watch to be worn on the outside of one of the heavy-duty gloves of a glove wearer, in cold or inclement weather, said glove having fingers, thumb, body and wrist portions, comprising a watch case having a face to display information, a length-adjustable elastic strap comprising a front strap portion extending from the case and stretching to loop about at least one glove finger, and a rear strap portion extending from the case and stretching outwardly to loop about the glove wrist to position the watch on the back of the glove, whereby the rear strap portion is maintained in position solely by the stretching of the elastic strap, the friction between the strap and the glove and by the cinching action of the loop around the glove wrist, such that the watch is readily removable from the glove by grasping the rear loop and stretching it to move over the glove body and thumb.

9. In combination with a glove having fingers, thumb, body and wrist portions, a watch to be worn on the outside of the glove, comprising a watch case having a face to display information, a length-adjustable elastic strap comprising a front strap portion extending from the case and stretching to loop about at least one glove finger, and a rear strap portion extending from the case and stretching outwardly to loop about the glove wrist to position the watch on the back of the glove, whereby the rear strap portion is maintained in position solely by the stretching of the elastic strap, the friction between the strap and the glove, and by the cinching action of the loop around the glove wrist, such that the device is readily removable from the glove by grasping the rear loop and stretching it to move over the glove body and thumb.

* * * * *